US006837174B1

(12) United States Patent
Baurley

(10) Patent No.: US 6,837,174 B1
(45) Date of Patent: Jan. 4, 2005

(54) PNEUMATIC BILGE LIQUID REMOVAL SYSTEM AND METHOD THEREFOR

(76) Inventor: Alfred Rudolph Baurley, 1241 SE. 14th St., Deerfield Beach, FL (US) 33441

( * ) Notice: Subject to any disclaimer, the term of this patent is extended or adjusted under 35 U.S.C. 154(b) by 0 days.

(21) Appl. No.: 10/687,045

(22) Filed: Oct. 16, 2003

(51) Int. Cl.[7] ..... B63B 13/00
(52) U.S. Cl. ..... 114/183 R
(58) Field of Search ..... 114/183 R

(56) References Cited

U.S. PATENT DOCUMENTS

| | | | | |
|---|---|---|---|---|
| 50,153 | A | 9/1865 | Palmer | |
| 1,813,255 | A | 7/1931 | Petre | |
| 2,522,077 | A | 9/1950 | Wahl et al. | 214/83.32 |
| 2,664,911 | A | 1/1954 | Thompson et al. | 137/205 |
| 2,976,814 | A | 3/1961 | Ver Planck et al. | 103/235 |
| 3,315,611 | A | 4/1967 | Thompson | 103/235 |
| 3,405,648 | A | 10/1968 | Long | 103/238 |
| 3,780,757 | A | 12/1973 | Jordan | 137/205 |
| 3,852,193 | A | 12/1974 | Jakubek et al. | 210/73 |
| 3,883,269 | A | 5/1975 | Wolff | 417/122 |
| 4,013,383 | A | 3/1977 | Rule | 417/366 |
| 4,057,364 | A | 11/1977 | Bratschitsch | 417/34 |
| 4,139,463 | A | 2/1979 | Murphy et al. | 210/73 |
| 4,408,960 | A | 10/1983 | Allen | 417/54 |
| 4,492,630 | A | 1/1985 | Rymal, Jr. | 210/117 |
| 4,623,452 | A | 11/1986 | Petersen | 210/104 |
| 4,632,157 | A | 12/1986 | Bunkofske | 141/38 |
| 5,044,295 | A | 9/1991 | Shimokawa | 114/183 |
| 5,152,670 | A | 10/1992 | Waldecker | 417/38 |

*Primary Examiner*—Jesus D. Sotelo
(74) *Attorney, Agent, or Firm*—Robert C. Kain, Jr.; Fleit Kain

(57) ABSTRACT

The invention relates to a pneumatic bilge liquid removal system including an air compressor having inlet and outlet ports pneumatically coupled to a valve system, a collection chamber with the top segment coupled to the valve system, at least one collection tube extending from the bilge to the collection chamber, a discharge tube coupled to the collection chamber, and a control system for the air compressor and valve system. The air compressor pressurizes the collection chamber via the outlet port for a first time interval causing the bilge liquid in the collection chamber to discharge through the discharge tube, and the air compressor creates a negative pressure in the collection chamber via the inlet port for a second time interval causing any the bilge liquid in the bilge to be drawn into and accumulate in the collection chamber via the collection tubes. A bilge liquid removal method is also provided.

39 Claims, 7 Drawing Sheets

PNEUMATIC BILGE LIQUID REMOVAL SYSTEM AND METHOD THEREFOR

The present invention relates to a pneumatic bilge liquid removal system for removal of bilge liquids from vessels and a method therefor.

BACKGROUND OF THE INVENTION

Mankind has been devising methods and creating devices to remove liquids from a vessel's bilge since the building of the first boat. During the age of exploration, the reliable bucket was replaced with a simple tube with a piston sealed with leather. The piston was raised and lowered causing the bilge liquid to be expelled. In modern times, electrical/mechanical bilge pumps have been utilized.

Today, automatic bilge pumps come in three basic forms: the centrifugal impeller, rubber lobe impeller and a diaphragm pump. All these designs share a common shortcoming. After the pump has cycled off or turned off, a base liquid level remains in the vessel's bilge. The present invention solves the problem of removing the base bilge liquid that remains after the primary bilge pumps have turned off.

The vertical shaft impeller, submersible pump disclosed in U.S. Pat. No. 4,013,383 to Clinton Rule is one of the most popular, durable and efficient bilge pumps available on the market today. However, despite its great capacity, it leaves a large amount of residual bilge water after it has completed a cycle. Generally, larger bilge pumps mean greater water flow, but also mean higher residual bilge liquid or water levels. Although smaller sized pumps provide lower residual water levels, smaller pumps would not be as helpful in keeping vessels afloat in the event of an emergency. Moreover, the centrifugal, vertical shaft impeller pumps need to reside in the bilge water, which over time, foul the pump. There is a need for a bilge liquid removal system in which the pump does not come in direct contact with the bilge liquid.

The lobe impeller pumps tend to pull the base water levels lower depending upon the installation. Lobe impeller pumps are typically mounted above the bilge because these pumps are generally not water proof. Similarly, the smaller the pump size and suction hose, the greater their ability to draw the water levels lower. Generally, the lobe impeller pumps require a lot of electrical power, produce much noise and have been known to overheat when run dry, causing the rubber lobe impellers to melt to the housing, and finally, seizing the pump.

The diaphragm pump works like the heart, in that it flexes causing valves to open and close. These pumps are able to draw a residual bilge water level to a lower level than the centrifugal and lobe impeller pumps because this type of pump can be left to run dry and has the ability to pump air. However, diaphragm pumps are typically very noisy, draw a lot of power, and are susceptible to debris being caught in one of the valves, disabling the pump.

The present invention solves the problem of residual bilge liquid or water by providing a bilge liquid removal system and method.

The prior art includes pneumatic disposal systems. For example, U.S. Pat. No. 3,780,757 to Jordan discloses a system for the servicing of toilet waste holding tanks. The system disclosed in '757 to Jordan selectively applies a vacuum or air pressure to a waste holding tank and a flushing fluid holding tank in order to draw the waste from the target waste holding tank. The intake hose for the removal of waste from the target holding tank includes a check valve.

U.S. Pat. No. 4,623,452 to Peterson discloses a pneumatic dockside system for the removal of bilge water and waste oil. The system disclosed in '452 to Peterson includes a dockside collection tank having the input pipe extending to the bottom of the vacuum tank. The input pipe is perforated to prevent syphoning from the vacuum tank back through the evacuator pipe.

U.S. Pat. No. 3,883,269 to Wolff discloses a pneumatic liquid transfer system for marine applications, and particularly with regard to storage and transfer of cargo aboard barges.

U.S. Pat. No. 1,813,255 to Petre discloses a pneumatic means for removal of bilge water from motor boats by utilizing an auxiliary chamber with a float for the collection of bilge water. The engine of the boat is used to create the vacuum in the chamber. When the float in the auxiliary chamber reaches a particular point, a valve opens permitting air to enter the chamber, destroying the partial vacuum. A one-way valve on the intake pipe closes and a similar valve on the exit pipe opens. This causes the accumulated bilge water to exit via an outlet pipe.

OBJECTS OF THE INVENTION

It is an object of the present invention to provide a pneumatic bilge liquid removal system that substantially removes residual bilge liquid or water from the bilge of a vessel.

It is another object of the present invention to provide a method for the removal of bilge liquid from the bilge of a vessel.

It is yet another object of the present invention to provide a secondary bilge water removal system to a primary bilge pump in order to remove the residual bilge water left after the primary system has cycled off.

It is a further object of the present invention to provide a bilge liquid removal system having small diameter, non-collapsible collection tubes such that even very small quantities of bilge liquid are transported through the tube into a collection chamber.

It is another object of the present invention to provide a bilge liquid removal system that can by programmed to operate on a predetermined cycle.

It is yet another object of the present invention to provide a bilge liquid removal system having remotely located collector plates capable of filtering debris from the bilge liquid prior to extraction via at least one collection tube.

SUMMARY OF THE INVENTION

The present invention relates to a pneumatic bilge liquid removal system for a vessel having a bilge with bilge liquid therein. The system includes an air compressor having inlet and outlet ports pneumatically coupled to a valve system, and a collection chamber having top and bottom segments, with the top segment pneumatically coupled to the valve system. The system also includes at least one collection tube extending from the bilge to the top segment of the collection chamber without intervening valves. A discharge tube having a one-way valve is coupled to the bottom segment of the collection chamber. The system also includes a control system means for energizing the air compressor and controlling the valve system such that the air compressor pressurizes the collection chamber via the outlet port for a first predetermined time interval causing the bilge liquid in the collection chamber to discharge through the discharge tube; and such that the air compressor creates a negative pressure in the collection chamber via the inlet port for a second predetermined time interval causing any of the bilge liquid in the bilge to be drawn into and accumulate in the collection chamber via the collection tubes.

The bilge liquid removal system collection tube is a non-collapsible tube having a cross-sectional area sufficiently small such that both liquid and a combination of liquid and gas are capable of being transported through the collection tube into the collection chamber when the air compressor is actuated. The optimal cross-sectional area of the collection tube may be considered as a function of the capacity of the air compressor. In one embodiment, the collection tubes have an overall length of between 20 feet and 150 feet.

In one embodiment, the control system means is an electric control system, and may include programmable electronics. The valve system may include electrically controlled valves controlled by the electric control system. The electrically controlled valves may be electric solenoid valves.

In one embodiment, the bilge liquid removal system includes a collector plate coupled to the collection tube at the bilge area. The collector plate includes a substantially downwardly facing surface defining bilge liquid collection channels converging at a common area near the collection tube. In the preferred embodiment of the collector plate, it includes a filter disposed on the downwardly facing surface such that the bilge liquid is filtered of debris prior to removal through the collection channels and the collection tube. The collector plates may have a planar shape, an angular shape, or a ski shape.

The present bilge liquid removal system may be used as a secondary system together with a primary bilge pump.

The present invention also relates to a method for removing bilge liquid from the bilge of a vessel, including the steps of providing a bilge liquid collection chamber with upper and lower regions; providing at least one small diameter collection tube extending from the bilge to the upper region of the collection chamber; providing a discharge port at the lower region of the collection chamber with a one way valve limiting flow solely for discharge; negatively pressurizing the bilge liquid collection chamber and the at least one collection tube through to the bilge; drawing the bilge liquid into the collection chamber via the at least one collection tube for a predetermined suction time interval; thereafter positively pressurizing the collection chamber and discharging the bilge liquid therefrom via the discharge tube while permitting nominal flow through the at least one collection tube.

BRIEF DESCRIPTION OF THE DRAWINGS

Further objects and advantages of the present invention can be found in the detailed on of the preferred embodiments when taken in conjunction with the accompanying drawings in which.

DETAILED DESCRIPTION OF THE PREFERRED EMBODIMENTS

Figure 1A:
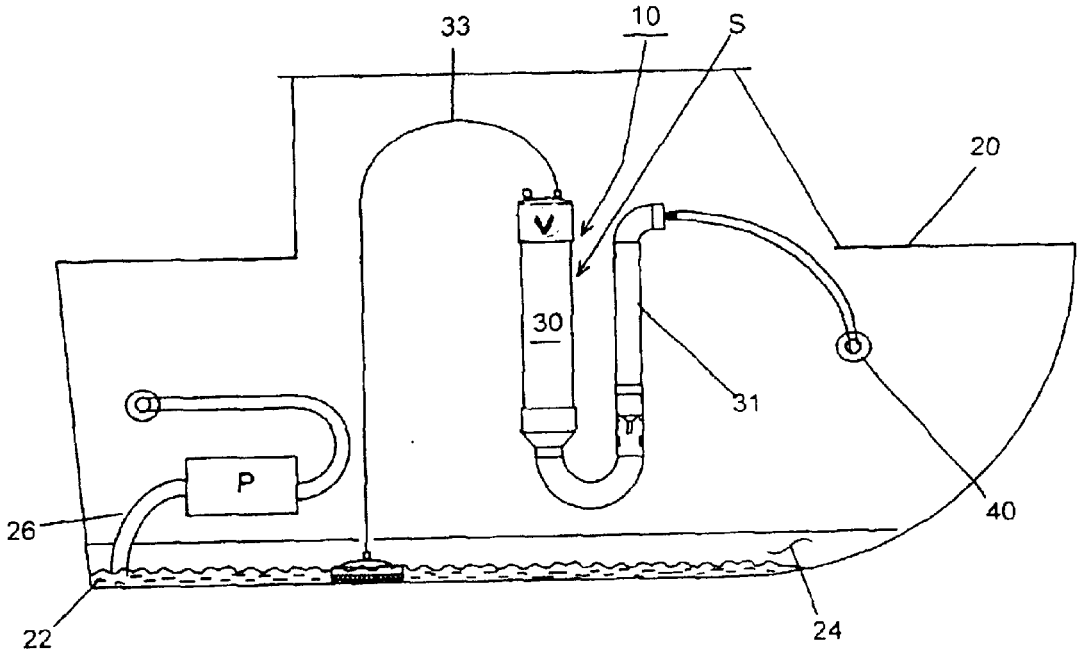
FIG. 1A diagrammatically illustrates a vessel having a pneumatic bilge liquid removal system.

The present invention relates to a pneumatic bilge liquid removal system and method therefor. The pneumatic bilge liquid removal system 10 is diagrammatically illustrated in FIG. 1A on vessel 20. The pneumatic bilge liquid removal system 10 is typically used aboard a vessel, but is capable of operating from a location outside the vessel with collection hoses extending into the bilge area 24 of the vessel. In the preferred embodiment of the bilge liquid removal system 10 of the present invention, the system 10 operates as a secondary system (shown as "S" in FIG. 1A) in cooperation with a primary bilge system P. Accordingly, the primary bilge system P may be any type of bilge pump, as described in the background, capable of removing a large volume of bilge liquid or water 22 from the bilge area 24. The present invention is then utilized as a secondary bilge liquid removal system to remove the residual bilge liquid remaining after the primary system has cycled off. Of course, the present system is capable of operating as a primary system, or simultaneously with or in tandem with another bilge pump system.

Bilge liquid 22 is typically water which has entered the vessel 20 from the body of water in which the vessel floats, rain water, or water used to wash down the vessel and may include other impurities such as oil, fuel, lubricants, grey water, and other liquids which have drained into the bottom of the vessel 24. Generally, the bilge areas 24 of a vessel are located near the bottom of a vessel. However, for purposes of understanding the usefulness of the present invention, the bilge of a vessel may also include other areas of a vessel where liquids tend to accumulate. For example, some vessels have storage chambers which do not drain into the main bilge areas of the vessel. Bilge, as used herein, is meant to encompass such areas. Similar reference numbers and letters represent similar components and system features throughout the drawings and the written description.

The pneumatic bilge liquid removal system 10 illustrated in FIG. 1A includes a bilge liquid collection tube 33 extending from the bilge of the vessel 20 to the collection chamber 30 of the system. The system 10 also includes a discharge tube 31 coupled to the bottom of the collection chamber 30 and extending to discharge port 40. Accordingly, a path for the removal of bilge liquid from the bilge to the outside of the vessel is defined.

Figure 1B:
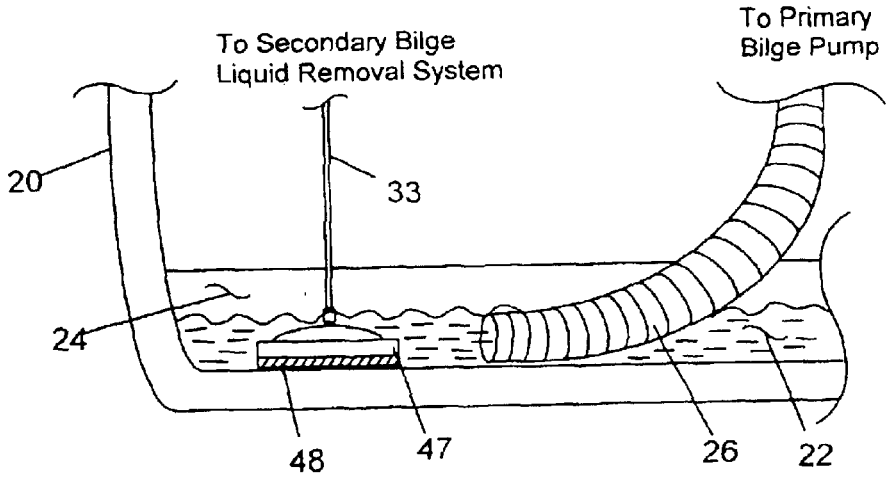
FIG. 1B diagrammatically illustrates a partial cutaway view of the bilge of a vessel showing the collection tubes for primary and secondary bilge liquid removal systems.

FIG. 1B diagrammatically illustrates a partial cutaway view of the bilge of a vessel showing the collection tubes for the primary and secondary bilge liquid removal systems. The collection tube 33 of the pneumatic bilge liquid system 10 of the present invention is shown having a small diameter relative to the larger diameter of the suction tube 26. Suction tube 26 illustrated in FIG. 1B would typically be connected to a diaphragm pump given that the pump is located above the bilge liquid 22 (see FIG. 1A). Collection tube 33 is coupled to collection plate 47 which lies at the bottom of bilge area 24. Collection plate 47 includes a filter 48 disposed on its downwardly facing surface to prevent the suction of debris that would otherwise clog the system.

Figure 2:
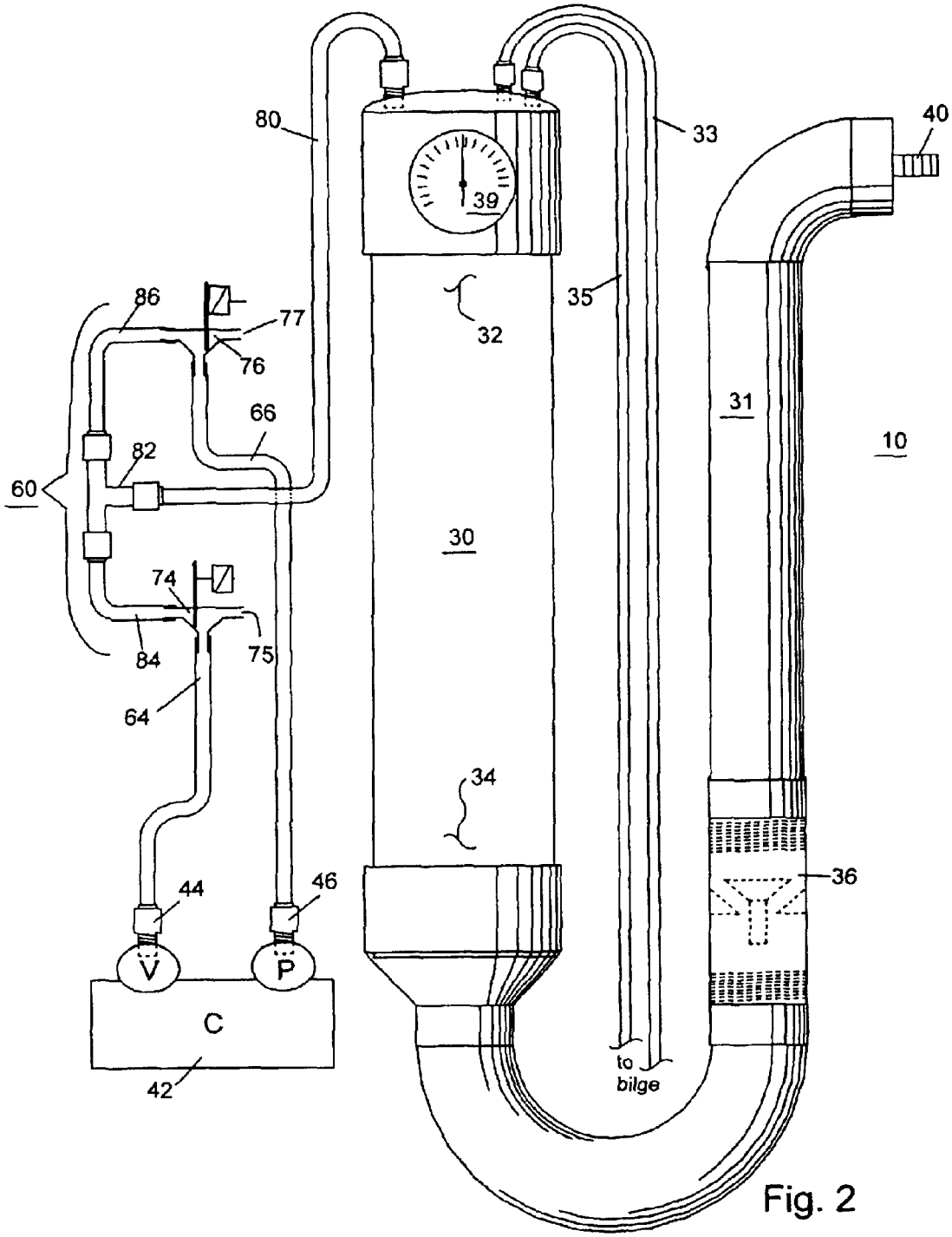
FIG. 2 diagrammatically illustrates a pneumatic bilge liquid removal system.

FIG. 2 diagrammatically illustrates one embodiment of the pneumatic bilge liquid removal system 10. The system includes an air compressor 42 having inlet 44 and outlet 46 ports. Inlet port 44 may also be referred to as the vacuum side or port and is labeled V for reference. Outlet port 46 outputs compressed air and is accordingly labeled P for pressure. Air compressor 42 is pneumatically coupled to valve system 60 via respective tubes 64, 66. In the embodiment illustrated in FIG. 2, air tube 64 extends from vacuum port 44 to valve 74. Air tube 66 extends from outlet port 46 to valve 76. Valves 74, 76 have respective open ports 75, 77. Valves 74, 76 are pneumatically coupled to collection chamber 30 via respective tubes 84, 86, T-fitting 82 and control tube 80.

The air tubes utilized herein may be metallic tubing, for example, copper tubing, or plastic tubing, or any other material commonly known in the art capable of operating under the conditions of negative and positive pressures as discussed herein. Plastic, non-collapsible tubing is preferred because of its non-oxidizing characteristic. The pneumatic bilge liquid removal system 10 may be placed anywhere on board, including the harsh environment of the engine room of a vessel, or the corrosive environment of the lazaret. Valves 74, 76 may be electric valves such as electric solenoid valves, but can be any other type of valve suitable for controlling the operation of the pneumatic bilge fluid removal system 10. The valve system 60 illustrated in FIG. 2 includes two valves 74, 76 coupled via respective tubes 84, 86 and T-fitting 82. However, valve system 60 may be a single component having multiple valves capable of being controlled as is known to those skilled in the art. For example, input and output ports 44, 46 of compressor 42 may be pneumatically connected to a valve manifold capable of controlling the flow of air. The embodiment illustrated in FIG. 2 is merely exemplary as there are numerous configurations available.

Collection chamber 30 is typically an elongated chamber having top and bottom segments 32, 34. The elongated shape is preferred because it tends to minimize the movement and splashing of bilge liquid accumulated inside the chamber 30 during operation of the vessel. The collection chamber 30 may be constructed of polyvinyl chloride (PVC), stainless steel or other material suitable for the storage of bilge liquid, capable of withstanding varying pressures. Because bilge liquid may often include salt water, gasoline, diesel fuel or other corrosive liquids, a fossil fuel-resistant plastic is the preferred material. The collection chamber 30 may be constructed using extruded plastic as is known in the art.

In FIG. 2, valve system 60 is pneumatically coupled to collection chamber 30 via tube 80. However, the valve system 60 may be directly coupled to collection chamber 30, similar to valve system 100 in FIG. 11. In the preferred embodiment, valve system 60 is pneumatically coupled to chamber 30 at the top of the chamber. This configuration provides protection against accidental intake of accumulated bilge liquid in the chamber 30 into control tube 80, valve system 60 or air compressor 42.

The bilge liquid removal system 10 includes at least one collection tube 33 extending from the bilge to the top segment 32 of the collection chamber 30. The embodiment illustrated in FIG. 2 includes two collection tubes 33, 35 extending to bilge areas on the vessel (see FIGS. 1A and 1B). In accordance with the present invention, these bilge areas may include other locations on the vessel where bilge liquid accumulates. The collection tubes 33, 35 of the present invention have no intervening one-way or check valves between the bilge areas and the storage chamber 30. This novel design operates because the collection tubes 33, 35 are non-collapsible tubes having relatively small cross-sectional areas in relation to the suction created by air compressor 42. Hence, the very small cross-sectional area of the collection tubes promotes the suction and transport of both bilge liquid and a combination of liquid and gas through the tube. Accordingly, even when there is little bilge liquid 22 left in the bilge 24, the small-dimensioned collection tube 33, together with the force of the suction created by the air compressor 42, allows even drops of bilge liquid to travel through the collection tubes 33, 35 to the collection chamber 30. The small cross-sectional dimension of the collection tubes 33, 35 is also beneficial during the discharge cycle (when the collection chamber 30 is being evacuated), because very little compressed air and bilge liquid is able to back flow through the collection tubes into the bilge. Hence, the cross-sectional area of the collection tube is a function of the capacity of the air compressor 42. In one embodiment, the collection tube 33 has an overall length between 20 feet and 150 feet. Other lengths will work.

Collection chamber 30 in FIG. 2 includes a pressure gauge 39 indicating the pressure inside the chamber. As will be explained, during operation of the bilge liquid removal system, the pressure in the chamber 30 varies from greater than ambient pressure to less than or negative pressure.

Discharge tube 31 or riser, is vertically oriented and is coupled to the bottom segment 34 of collection chamber 30. Discharge tube or riser 31 typically extends to a discharge port 40 (FIG. 1A) which permits discharged bilge liquid to exit the vessel into the surrounding body of water. Tube 31 is typically of larger diameter than the collection tubes 33, 35 in order to provide less resistance to exiting bilge liquid. Discharge tube 31 may also be coupled to a filter or fuel separator in order to remove impurities from the bilge liquid prior to exiting the vessel. Such filtering devices and fuel separators are known in the art. Discharge tube 31 includes a one-way valve 36. One-way valve 36 serves to provide a substantially sealed discharge tube during the filling of the collection chamber 30 with bilge liquid, and serves to prevent discharged bilge liquid from flowing back into the chamber 30. In this manner, water "rises" in the tube 31 to seal the valve 36. The one-way valve may be a check valve or flapper valve or any other suitable valve which would prevent any significant back flow of air or liquid through discharge tube 31.

Figure 3:
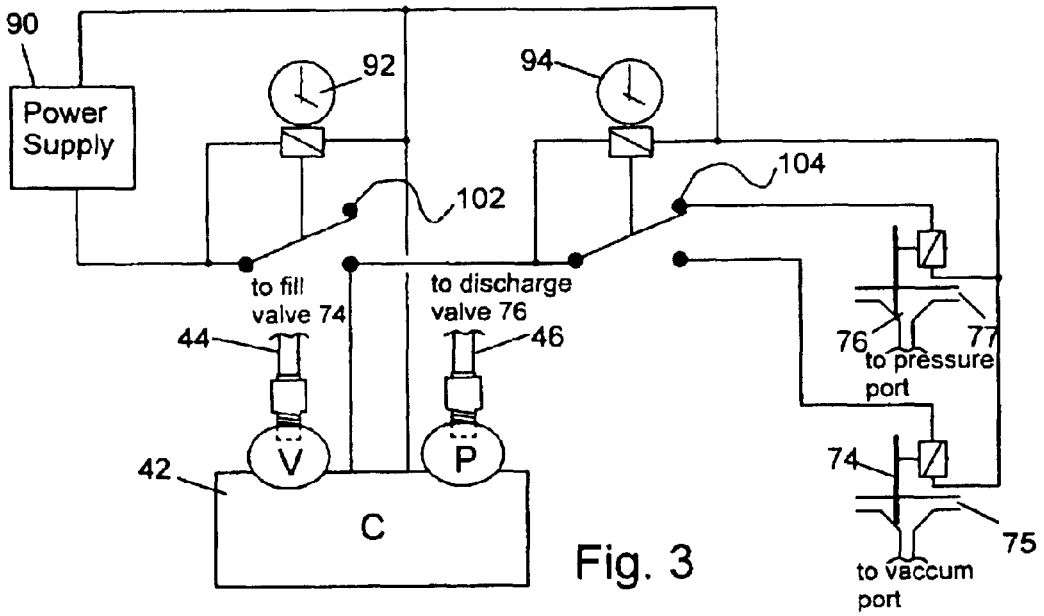
FIG. 3 diagrammatically illustrates an electric control system for the bilge liquid removal system.
Figure 4:
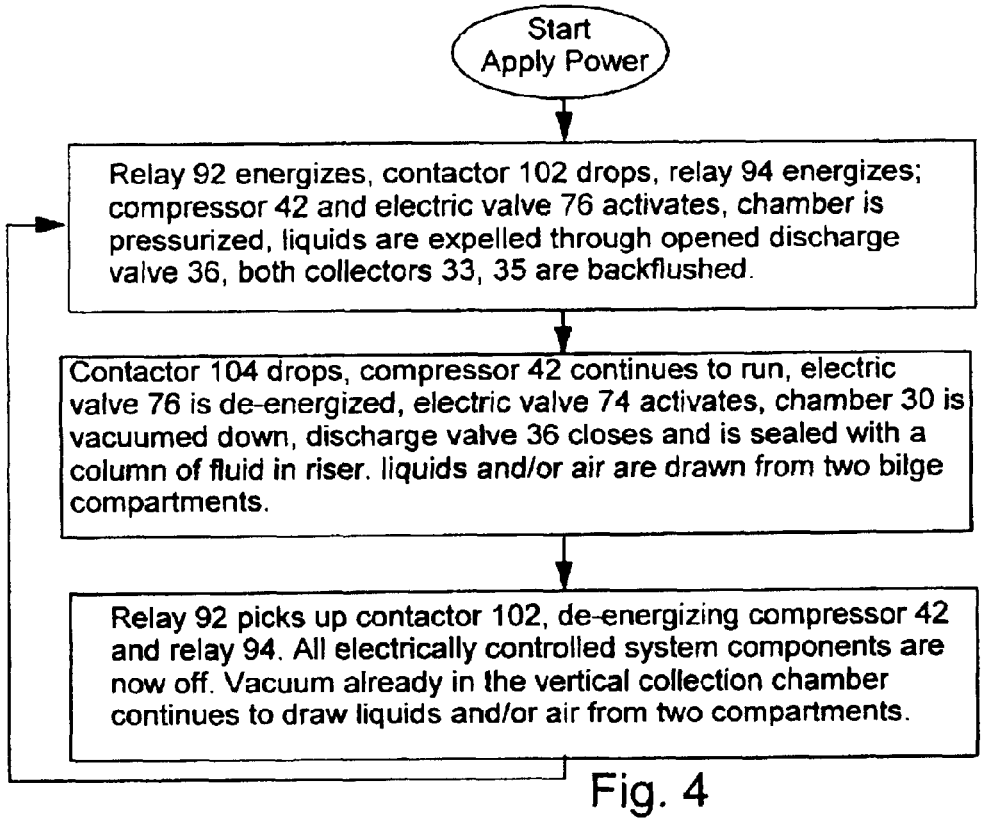
FIG. 4 illustrates a flow chart for the operation of one embodiment of the pneumatic bilge liquid removal system.

FIG. 3 diagrammatically illustrates an electric control system for the bilge liquid removal system 10. The embodiment illustrated in FIG. 3 includes two time delay relays 92, 94, power supply 90, and two electrically operated valves 74, 76. The power supply 90 provides power to compressor 42 and to the time delay relays as shown. Although there are numerous electrical configurations that could be utilized to make the bilge liquid removal system 10 work, an exemplary control circuit is provided in FIG. 3 to facilitate understanding its operation. In FIG. 3, valves 74, 76 diagrammatically represent respective fill and discharge electric solenoid valves which are normally open when de-energized, i.e. in the position shown in FIG. 3. In accordance with the control circuit, when power is applied to the circuit at 90, time delay relay 92 is energized. After a first predetermined time, contactor 102 drops, energizing compressor 42, and energizing time delay relay 94. Contactor 104, as illustrated, energizes solenoid discharge valve 76 causing the valve to close off or cut off open port 77. As illustrated in FIG. 2, compressor 42 operates, causing air to input through open port 75 into valve 74, through tube 64, through compressor 42, out tube 66, through valve 76, through tube 86, T-fitting 82, tube 80, and into collection chamber 30, thus pressurizing chamber 30. The pressure in chamber 30 causes any accumulated liquid in chamber 30 to expel through discharge tube 31, including one-way valve 36, and out port 40. It is desirable that the system 10 conduct an evacuation cycle initially to confirm that the collection chamber 30 is substantially empty to begin a fill cycle.

After a second predetermined time, time delay relay 94 drops contactor 104, de-energizing electric solenoid valve 76 and energizing electric solenoid, fill valve 74. Under this condition, valve 76 returns to its normally open position, allowing air to exit open port 77, and valve 74 closes, causing open port 75 to close. Compressor 42 continues to run, pulling air from collection chamber 30 via tube 80, T-fitting 82, tube 84, valve 74 and tube 64, and expelling the air via pressure port P, tube 66, valve 76 and out open port 77. Under this condition, compressor 42 is creating a vacuum condition or negative pressure condition (compared to the ambient pressure) in collection chamber 30. Because one-way valve 36 is closed, the negative pressure condition extends through collection tubes 33, 35, causing bilge liquid at the extremities of tubes 33, 35 to be pulled through the tubes into collection chamber 30. Because of the small cross-sectional area of the collection tube 33, the system 10 is capable of drawing a combination of bilge liquid and gas into the collection chamber 30. Liquid droplets are drawn into collection chamber during the predetermined second time interval. The second predetermined time interval may be determined by relay 94. Relay timer 94 opens and closes valves 102, 104 to achieve the functional operations described herein.

The third time interval is the "rest cycle." Here the vacuum continues to draw liquids and/or gases after relay 92 cycles compressor 42 and valves 74, 76 off. Here the vacuum or negative pressure previously created in chamber 30 continues to draw liquids and/or gases through tubes 33 and 35 to chamber 30.

After the third predetermined time interval, the system 10 reverts to the previous configuration wherein air compressor 42 begins pressurizing collection chamber 30. As air pressure in collection chamber 30 surpasses the ambient air pressure outside the chamber, bilge liquid accumulated in chamber 30 is pushed down into discharge tube 31. As bilge liquid travels through discharge tube 31, one-way valve 36 opens and bilge liquid is expelled through port 40. During the evacuation cycle, some of the air pressure will cause at least part of the bilge liquid remaining in collection tubes 33, 35 to travel toward the bilge areas. However, because the tubes have relatively small cross-sectional areas, the amount of bilge liquid back-flushed into the bilge will be minimal in comparison to the amount of accumulated bilge liquid evacuated through discharge tube 31.

A timer for system 10 may energize the system once every hour for ten minutes, or once every day for 20 minutes, or any other predetermined schedule. If the present invention is utilized in conjunction with a primary bilge pump, the present pneumatic system 10 may also be triggered by the cycling off of the primary system P (FIG. 1A) such that the pneumatic system 10 removes the residual bilge liquid left by the primary system.

The predetermined time intervals are calculated or determined based upon several variables which include, the capacity of the collection chamber 30, the capacity of the air compressor 42, the number of collection tubes 33, 35, and the discharge rate of the bilge liquid through the discharge tube 31. The discharge rate may be lower when the discharge tube 31 is coupled to a fuel separator or other filter. The circuitry involved in the sequencing and timing of the pneumatic bilge liquid removal system 10 may be accomplished through a single relay having programmable time delays for pickup and dropout times. In addition, a programmable logic array (PLA) or other programmable electronics may also be implemented to control the operation of the compressor and electric valves. The use and implementation of PLA's and other programmable chips are known to those skilled in the art.

Accordingly, the present invention includes a method for removing bilge liquid from the bilge of a vessel. The method includes the steps of providing a bilge liquid collection chamber 30 with upper and lower regions 32, 34, respectively; providing at least one small diameter collection tube 33 extending from the bilge to the upper region 32 of the collection chamber 30; providing a discharge port 40 at the lower region 34 of the collection chamber 30 with a one-way valve 36 limiting flow solely for discharge; negatively pressurizing the bilge liquid collection chamber 30 and the collection tube 33 through to the bilge; drawing the bilge liquid into the collection chamber 30 via the collection tube 33 for a predetermined suction time interval; thereafter positively pressurizing the collection chamber 30; and discharging the accumulated bilge liquid therefrom via the discharge tube 31 while permitting nominal flow through the collection tube 33.

The pneumatic bilge liquid removal system 10 may be equipped with collector plates 47 at the terminal ends of the collection tubes 33, 35. The collector plates 47 serve to hold the end of the collection tube stationary, to provide filtration so as to avoid a collection tube being obstructed by debris present in the bilge liquid, and to provide alternative travel paths for the bilge liquid to reach the collection tube 30. Because the structures of the bilge areas of vessels vary greatly, the present invention includes several embodiments for the collector plate 47.

Figure 6A:
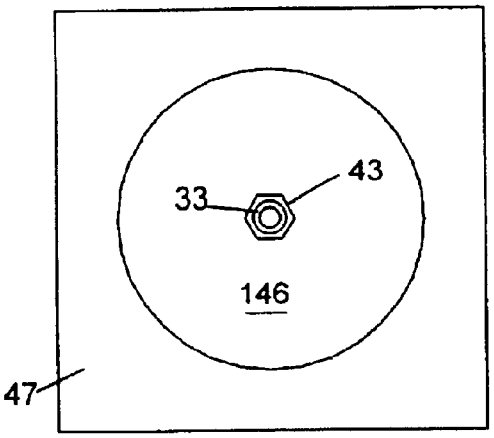
FIG. 6A diagrammatically illustrates a planar-shaped bilge liquid collector plate.
Figure 6B:
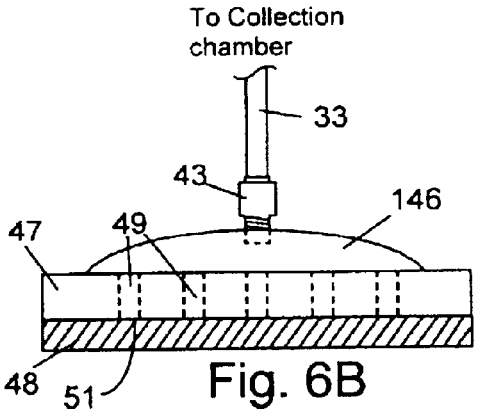
FIG. 6B diagrammatically illustrates a side view of the collector plate in FIG. 6A.

FIG. 6A diagrammatically illustrates a planar-shaped bilge liquid collector plate 47. Collector plate 47 is made of a heavy material in order that the plate remain relatively stationary in the bilge, even when the vessel is moving. The collector plate 47 includes a dome 146. One terminal end of collector tube 33 is coupled to the dome 146 via coupling or fitting 43. FIG. 6B diagrammatically illustrates a side view of the collector plate in FIG. 6A. The collector plate 47 defines a plurality of collection channels 49 that lead to dome 146. The downwardly facing surface 51 is covered by a filter material 48. The filter 48 is typically constructed of fuel resistant mesh-like material. Accordingly, during a fill cycle, bilge liquid is suctioned through filter material 48, through channels 49, through dome 146, and into collection tube 33. The collector plate 47 with the filter material 48 prevents debris in the bilge liquid from obstructing the collector tube 33. Even if one area of the filter 48 becomes plugged with debris, the bilge liquid is able to enter the collection channels 49 via non-plugged areas.

Figure 7A:
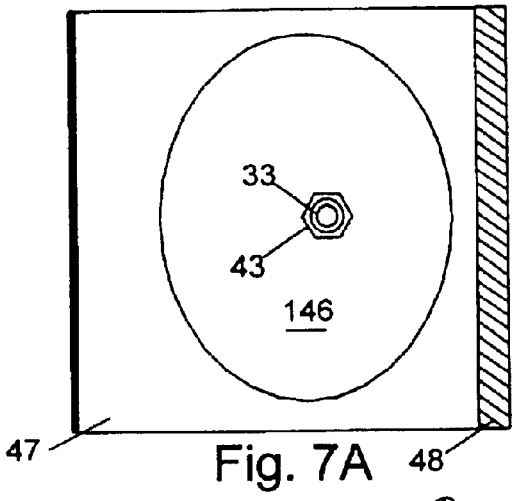
FIG. 7A diagrammatically illustrates another embodiment of a bilge liquid collector FIG. 7B diagrammatically illustrates a side view of the ski-shaped collector plate illustrated in FIG. 7A.
Figure 7B:
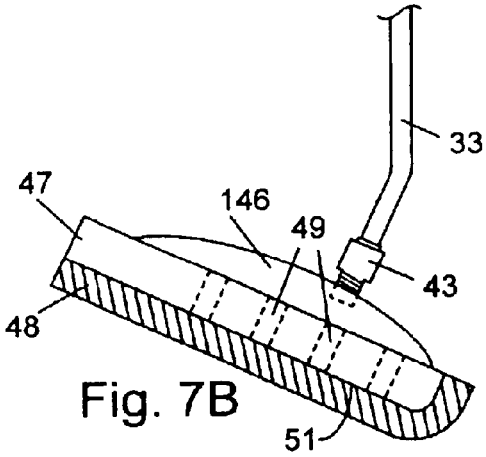
Figure 8:
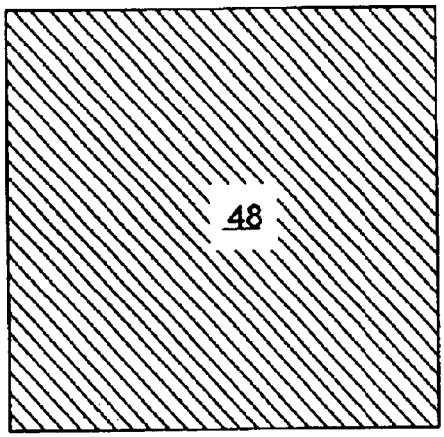
FIG. 8 diagrammatically illustrates a bottom view of the bilge liquid collector plate.
Figure 9A:
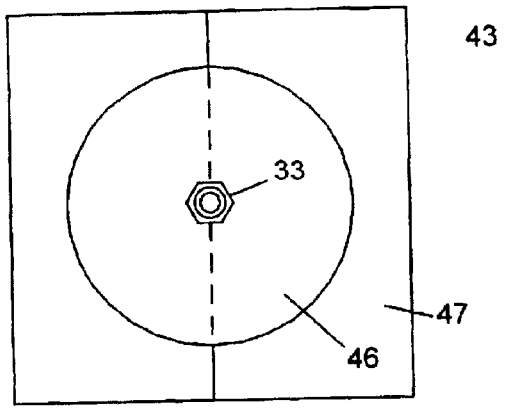
FIGS. 9A–9F diagrammatically illustrate another embodiment of an bilge liquid collector plate having an angular shape.
Figure 9B:
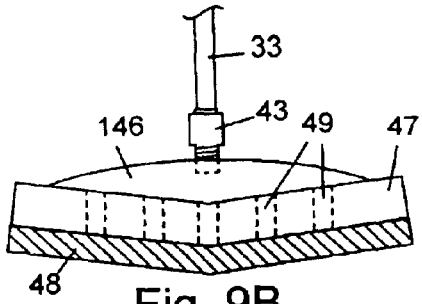
Figure 9C:
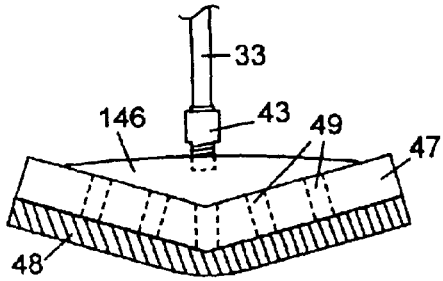

Similarly, FIG. 7A diagrammatically illustrates another embodiment of a bilge liquid collector plate 47 having a ski-shape. FIG. 7B diagrammatically illustrates a side view of the ski-shaped collector plate illustrated in FIG. 7A. The ski-shape is particularly useful when the bilge area is pitched or angled. This is often the case with bilge areas near a vessel's stringers. FIG. 8 diagrammatically illustrates a bottom view of the bilge liquid collector plate 47.

Figure 9D:
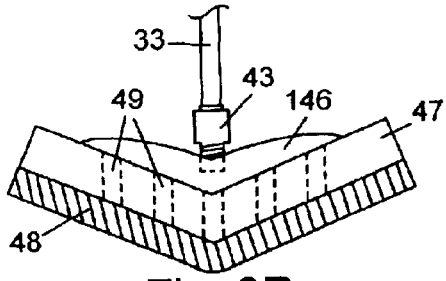
Figure 9F:
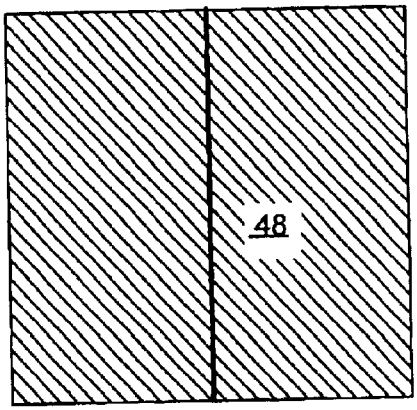
Figure 9E:
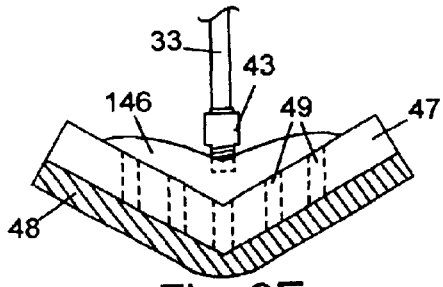

FIGS. 9A–9F diagrammatically illustrate other embodiments of a bilge liquid collector plate 47 having an angular shape. The angular shape is particularly beneficial in bilge areas at the keel of a vessel. FIGS. 9B–9E illustrate collector plates 47 having different angles in order to match a collector plate with the bilge surface. FIG. 9F is a bottom view of the angular collector block 47. Although FIGS. 6A, 7A, 8, 9A and 9F show collector plates having a substantially square shape, other shapes may be used. For example, in FIG. 10, collector plate 47 is circular.

Figure 10:
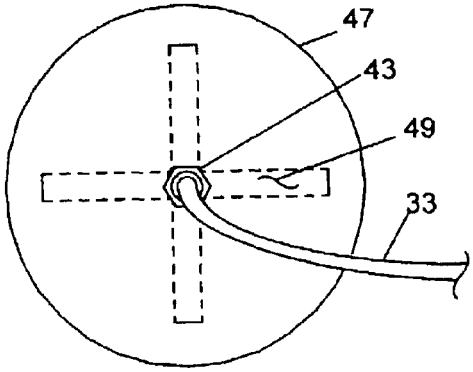
FIG. 10 diagrammatically illustrates a circular bilge liquid collector plate having collection channels.

The collector plate 47 of FIG. 10 includes collection channels 49 that run lengthwise across the plate 47. Using this configuration, the spherical dome 146 is not required. The terminal end of collection tube 33 may be coupled directly to the plate 47 via fitting 43.

Figure 5:
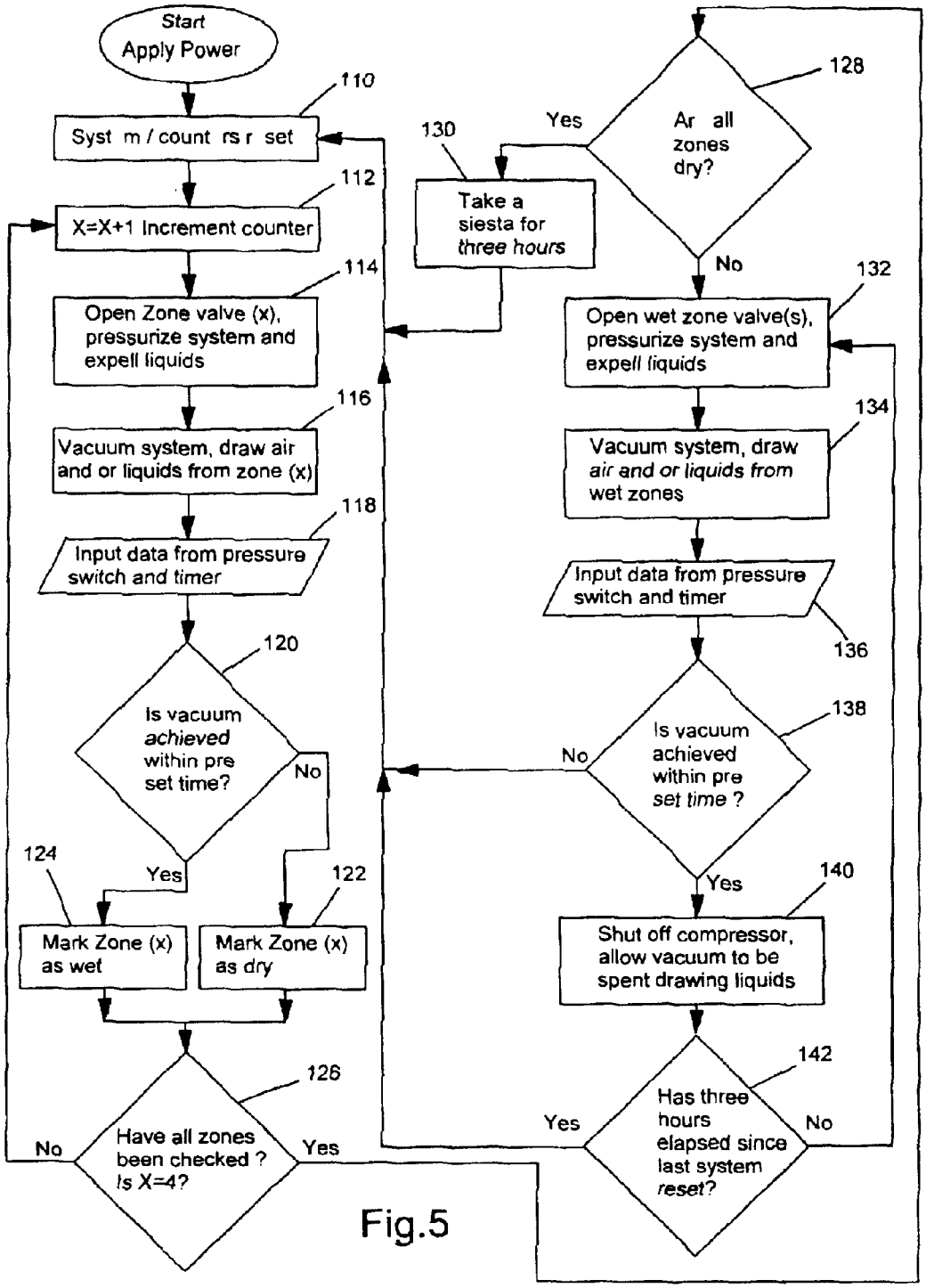
FIG. 5 illustrates a flow chart for the operation of another embodiment of the pneumatic bilge liquid removal system.

FIG. 5 provides a flow chart for the operation of an embodiment of the pneumatic bilge liquid removal system 10 utilizing programmable electronics.

Figure 11:
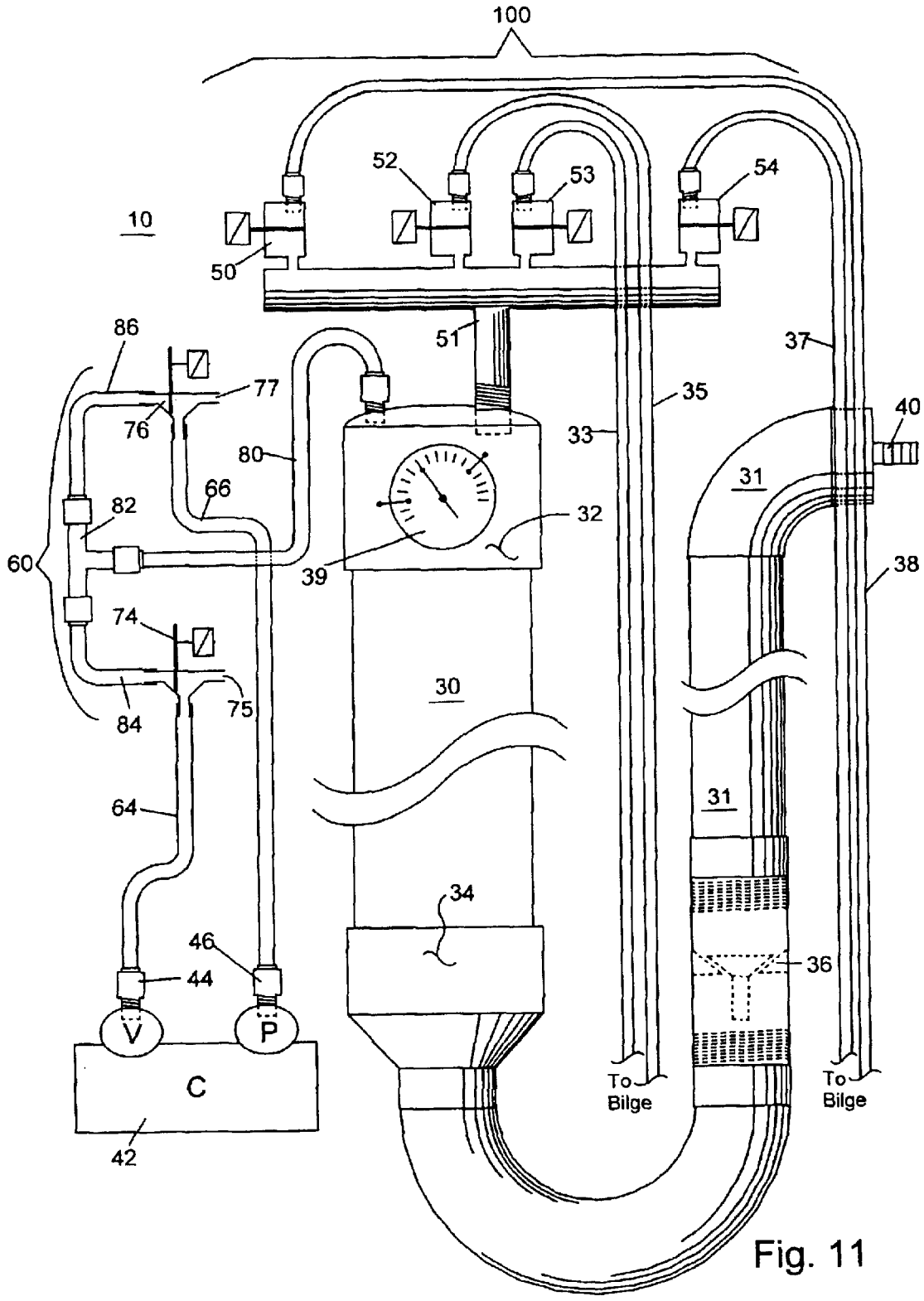
FIG. 11 diagrammatically illustrates another embodiment of the pneumatic bilge liquid removal system.

FIG. 11 diagrammatically illustrates another embodiment of the pneumatic bilge liquid removal system 10. The pneumatic system 10 includes a plurality of collection tubes 33, 35, 37, 38. The multiple collection tubes 33, 35, 37, 38 extend to different bilge areas within the vessel. The collection tubes are coupled to a valve manifold or system 100. Collection tube valve system 100 includes a series of corresponding, electrically controlled valves 50, 52, 53, 54 to control which collection tube 33, 35, 37, 38 is pneumatically coupled to collection chamber 30. Using this arrangement, a vessel utilizing this configuration may be organized into different zones. The bilge liquid removal system 10 may be programmed to alternate among different zones for the removal of bilge liquids. It is important to note that the system 10 illustrated in FIG. 11 operates in the same manner as the system of FIG. 2, except that the system is capable of removing bilge liquid from different zones, depending upon programming or control of selector valves 50, 52, 53 and 54. Additionally, it is important to note that no matter which zone is active, i.e., which collection tube 33, 35, 37 or 38 is selected via the selector valves, the engaged collector tube or tubes will have no intervening obstructions from the collection chamber 30 extending out to the bilge zone or area.

FIG. 5 provides a flowchart explaining the operation of a bilge liquid removal system 10 having multiple zones similar to the embodiment illustrated in FIG. 11. The system 10 is programmable. Upon activation of the system 10 at 110, the system is reset, i.e. all counters representing different bilge zones are reset. At step 112, the system increments the counter representing the active zone. Hence, if on activation, the counter is at 0, at step 112, the counter becomes 0+1=1, i.e. the active zone is zone 1. At step 114, the system opens zone selector valve 50 (representative of zone 1) and performs an evacuation cycle for a predetermined time to begin bilge liquid removal with an empty collection chamber. At 116, the system 10 performs a fill cycle by pulling a vacuum on collection chamber 30 to draw bilge liquid from zone 1 (collection tube 38 in FIG. 11) for a second predetermined time. At 118, pressure gauge data and time data are input into the programmable control circuit to determine whether the pressure is at an acceptable level and whether sufficient time has elapsed. At decision point 120, the system determines whether a sufficient vacuum has been achieved within a predetermined amount of time. If the pressure has not dropped to a sufficient level, then sufficient air is being sucked through collection tube 38 to replace the air being removed from collection chamber 30 by compressor 42, indicating little or no bilge fluid remains at zone 1. If the proper vacuum or negative pressure level has not been achieved, then the system 10 sets zone 1 as sufficiently dry (122). If the pressure in collection chamber 30 is at or below the predetermined threshold, then the system sets zone 1 as wet at 124. At decision point 126, the system determines whether all zones have been checked. If no, then the system returns to block 112 to increment the zone counter by 1. The system then conducts the same series of steps to determine the status of the various zones. This continues until all zones have been checked.

Once all zones have been checked, the system proceeds to determine whether its data reflects that all zones are substantially dry at 128. If all the zones are dry, the system rests for a predetermined duration (see FIG. 5, 130), and then the system resets and begins anew at 110.

If any of the zones remain wet, then the system 10 performs an evacuation cycle and fill cycle for that zone, retrieving input data regarding pressure and time to determine when the particular zone has become sufficiently dry (see steps 132, 134, 136, 138). With respect to functions 132, 134, 136, 138, the system simultaneously evacuates multiple zones (the wet zones), until a "no vacuum" condition is achieved, and then the system returns to the single zone check in steps 110, 112–120. If the remaining "wet" zone remains "wet", i.e. a sufficient negative pressure has been achieved within a predetermined time, then the system turns off the compressor 42 at 140. The vacuum in the collection chamber 30 will cause the particular zone to continue suctioning bilge liquid. Next, the system determines whether sufficient time has elapsed 142 since the last system reset. If no, the system continues to 132 in order to perform further evacuation and fill cycles for remaining "wet" zones. If sufficient time has elapsed since the last reset, the system begins the entire process at 10, resetting all counters and variables.

The bilge liquid removal system 10 of the present invention may be programmed using numerous timing cycles and zones. The embodiment of FIG. 11 and flow chart of FIG. 5 are merely exemplary. As will be evident to one skilled in the art, the system may be programmed to perform more evacuation and fill cycles or to perform test cycles in zones which are historically prone to bilge liquid buildups. Conversely, the system may be programmed to check non-traditional bilge areas, such as storage chambers, less frequently.

The claims appended hereto are meant to cover modifications and changes within the scope and spirit of the present invention.

What is claimed is:

1. A pneumatic bilge liquid removal system for a vessel having a bilge with bilge liquid therein, said system comprising:

an air compressor having inlet and outlet ports pneumatically coupled to a valve system;

a collection chamber having top and bottom segments, said top segment pneumatically coupled to said valve system;

at least one collection tube extending from said bilge to said top segment of said collection chamber without any intervening valves;

a discharge tube coupled to said bottom segment of said collection chamber and having a one-way valve therein;

a control system means for energizing said air compressor and controlling said valve system such that said air compressor pressurizes said collection chamber via said outlet port for a first predetermined time interval causing said bilge liquid in said collection chamber to discharge through said discharge tube; and such that said air compressor creates a negative pressure in said collection chamber via said inlet port for a second predetermined time interval causing any said bilge liquid in said bilge to be drawn into and accumulate in said collection chamber via said at least one collection tube.

2. A bilge liquid removal system as claimed in claim 1 wherein said at least one collection tube is a non-collapsible tube having a cross-sectional area sufficiently small such that both liquid and a combination of liquid and gas are capable of being transported through said collection tube into said collection chamber when said air compressor is actuated.

3. A bilge liquid removal system as claimed in claim 1 wherein said at least one collection tube is a non-collapsible tube having a cross-sectional area that is a function of the capacity of said air compressor.

4. A bilge liquid removal system as claimed in claim 1 wherein said at least one collection tube has an overall length of between 20 feet and 150 feet.

5. A bilge liquid removal system as claimed in claim 1 wherein said control system means is an electric control system.

6. A bilge liquid removal system as claimed in claim 5 wherein said electric control system includes programmable electronics and said valve system includes electrically controlled valves controlled by said electric control system.

7. A bilge liquid removal system as claimed in claim 6 wherein said electrically controlled valves are solenoid valves.

8. A bilge liquid removal system as claimed in claim 1 further comprising a collector plate coupled to said at least one collection tube at said bilge, said collector plate including a substantially downwardly facing surface defining bilge liquid collection channels converging at a common area near said collection tube.

9. A bilge liquid removal system as claimed in claim 8 wherein said collector plate includes a filter disposed on said downwardly facing surface such that said bilge liquid is filtered prior to removal through said collection channels and said collection tube.

10. A bilge liquid removal system as claimed in claim 9 wherein said downwardly facing surface of said collector plate defines one of a shape from the group of a planar shape, an angular shape, and a ski shape.

11. A bilge liquid removal system as claimed in claim 1 wherein said discharge tube is adapted to permit discharge of bilge liquid outside of said vessel.

12. A bilge liquid removal system as claimed in claim 1 wherein said inlet and outlet ports of said air compressor are pneumatically coupled to said valve system via respective vacuum and pressurization tubes.

13. A bilge liquid removal system for removing bilge liquid from a bilge of a vessel, the removal system comprising:

a primary bilge system including a bilge pump having a bilge liquid intake extending to the bilge of a vessel and a bilge liquid discharge for removing bilge liquid from said bilge via said bilge liquid intake and said pump to a location outside of the vessel;

a secondary pneumatic bilge liquid removal system comprising an air compressor having inlet and outlet ports pneumatically coupled to a valve system;

a collection chamber having top and bottom segments, said top segment pneumatically coupled to said valve system;

at least one collection tube extending from said bilge to said top segment of said collection chamber without intervening valves;

a discharge tube coupled to said bottom segment of said collection chamber and having a one-way valve therein; and a control system means adapted to operate in conjunction with said primary bilge system, said control system means for energizing said air compressor and controlling said valve system such that said air compressor pressurizes said collection chamber via said outlet port for a first predetermined time interval causing said bilge liquid in said collection chamber to discharge through said discharge tube; and such that said air compressor creates a negative pressure in said collection chamber via said inlet port for a second predetermined time interval causing any said bilge liquid in said bilge to be drawn into and accumulate in said collection chamber via said at least one collection tube.

14. A bilge liquid removal system as claimed in claim 13 wherein said at least one collection tube is a non-collapsible tube having a cross-sectional area sufficiently small such that both liquid and a combination of liquid and gas are capable of being transported through said collection tube into said collection chamber when said air compressor is actuated.

15. A bilge liquid removal system as claimed in claim 13 wherein said at least one collection tube is a non-collapsible tube having a cross-sectional area that is a function of the capacity of said air compressor.

16. A bilge liquid removal system as claimed in claim 13 wherein said at least one collection tube has an overall length of between 20 feet and 150 feet.

17. A bilge liquid removal system as claimed in claim 13 wherein said control system means is an electric control system.

18. A bilge liquid removal system as claimed in claim 17 wherein said electric control system includes programmable electronics and said valve system includes electrically controlled valves controlled by said electric control system.

19. A bilge liquid removal system as claimed in claim 18 wherein said electrically controlled valves are solenoid valves.

20. A bilge liquid removal system as claimed in claim 13 further comprising a collector plate coupled to said at least one collection tube at said bilge, said collector plate including a substantially downwardly facing surface defining bilge liquid collection channels converging at a common area near said collection tube.

21. A bilge liquid removal system as claimed in claim 20 wherein said collector plate includes a filter disposed on said downwardly facing surface such that said bilge liquid is filtered prior to removal through said collection channels and said collection tube.

22. A bilge liquid removal system as claimed in claim 21 wherein said downwardly facing surface of said collector plate defines one of a shape from the group of a planar shape, an angular shape, and a ski shape.

23. A bilge liquid removal system as claimed in claim 13 wherein said discharge tube is adapted to permit discharge of bilge liquid outside of said vessel.

24. A bilge liquid removal system as claimed in claim 13 wherein said inlet and outlet ports of said air compressor are pneumatically coupled to said valve system via respective vacuum and pressurization tubes.

25. In combination with a primary bilge system, the primary bilge system including a bilge pump having a bilge liquid intake located in the bilge of a vessel and a bilge liquid discharge for removing bilge liquid via said bilge liquid intake and said pump to a location out of the vessel;

a secondary pneumatic bilge liquid removal system for said vessel comprising:

an air compressor having inlet and outlet ports pneumatically coupled to a valve system;

a collection chamber having top and bottom segments, said top segment pneumatically coupled to said valve system;

at least one collection tube extending from said bilge to said top segment of said collection chamber without intervening valves;

a discharge tube coupled to said bottom segment of said collection chamber and having a one-way valve therein;

a control system means adapted to operate in conjunction with said primary bilge system, said control system means for energizing said air compressor and controlling said valve system such that said air compressor pressurizes said collection chamber via said outlet port for a first predetermined time interval causing said bilge liquid in said collection chamber to discharge through said discharge tube; and such that said air compressor creates a negative pressure in said collection chamber via said inlet port for a second predetermined time interval causing said bilge liquid in said bilge to be drawn into and accumulate in said collection chamber via said at least one collection tube.

26. A secondary pneumatic bilge liquid removal system as claimed in claim 25 wherein said at least one collection tube is a non-collapsible tube having a cross-sectional area sufficiently small such that both liquid and a combination of liquid and gas are capable of being transported through said collection tube into said collection chamber when said air compressor is actuated.

27. A secondary pneumatic bilge liquid removal system as claimed in claim 25 wherein said at least one collection tube is a non-collapsible tube having a cross-sectional area that is a function of the capacity of said air compressor.

28. A secondary pneumatic bilge liquid removal system as claimed in claim 25 wherein said at least one collection tube has an overall length of between 20 feet and 150 feet.

29. A secondary pneumatic bilge liquid removal system as claimed in claim 25 wherein said control system means is an electric control system.

30. A secondary pneumatic bilge liquid removal system as claimed in claim 29 wherein said electric control system includes programmable electronics and said valve system includes electrically controlled valves controlled by said electric control system.

31. A secondary pneumatic bilge liquid removal system as claimed in claim 30 wherein said electrically controlled valves are solenoid valves.

32. A secondary pneumatic bilge liquid removal system as claimed in claim 25 further comprising a collector plate coupled to said at least one collection tube at said bilge, said collector plate including a substantially downwardly facing surface defining bilge liquid collection channels converging at a common area near said collection tube.

33. A secondary pneumatic bilge liquid removal system as claimed in claim 32 wherein said collector plate includes a filter disposed on said downwardly facing surface such that said bilge liquid is filtered prior to removal through said collection channels and said collection tube.

34. A secondary pneumatic bilge liquid removal system as claimed in claim 33 wherein said downwardly facing surface of said collector plate defines one of a shape from the group of a planar shape, an angular shape, and a ski shape.

35. A secondary pneumatic bilge liquid removal system as claimed in claim 25 wherein said discharge tube is adapted to permit discharge of bilge liquid outside of said vessel.

36. A secondary pneumatic bilge liquid removal system as claimed in claim 25 wherein said inlet and outlet ports of said air compressor are pneumatically coupled to said valve system via respective vacuum and pressurization tubes.

37. A method for removing bilge liquid from the bilge of a vessel, the method comprising:

providing a bilge liquid collection chamber with upper and lower regions;

providing at least one small diameter collection tube extending from said bilge to said upper region of said collection chamber;

providing a discharge port at said lower region of said collection chamber with a one way valve limiting flow solely for discharge;

negatively pressurizing said bilge liquid collection chamber and said at least one collection tube through to said bilge;

drawing said bilge liquid into said collection chamber via said at least one collection tube for a predetermined suction time interval;

thereafter positively pressurizing said collection chamber and discharging said bilge liquid therefrom via said discharge tube while permitting nominal flow through said at least one collection tube.

38. A method for removing bilge liquid from the bilge of a vessel as claimed in claim 37 wherein said positively pressurizing said collection chamber and said discharging said bilge liquid steps occur prior in time to said negatively pressurizing said collection chamber and said drawing said bilge liquid steps.

39. A method for removing bilge liquid from the bilge of a vessel as claimed in claim 38 further comprising controlling said negatively pressurizing, drawing, positively pressurizing and discharging steps via an electric control system which energizes electric valves pneumatically connected to an air compressor and said collection chamber.

* * * * *